US008752993B2

(12) United States Patent
Yu

(10) Patent No.: US 8,752,993 B2
(45) Date of Patent: Jun. 17, 2014

(54) BACKLIGHT MODULE WITH OPTIC FILM ASSEMBLY MOUNTED THROUGH SNAP FITTING

(75) Inventor: Gang Yu, Guangdong (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 13/575,301

(22) PCT Filed: Jun. 8, 2012

(86) PCT No.: PCT/CN2012/076614

§ 371 (c)(1),
(2), (4) Date: Jul. 26, 2012

(87) PCT Pub. No.: WO2013/177817

PCT Pub. Date: Dec. 5, 2013

(65) Prior Publication Data

US 2013/0322119 A1 Dec. 5, 2013

(30) Foreign Application Priority Data

Jun. 1, 2012 (CN) ..... 2012 1 0178904

(51) Int. Cl.
*G09F 13/18* (2006.01)

(52) U.S. Cl.
USPC ..... 362/611; 362/607

(58) Field of Classification Search
USPC ..... 362/611, 607, 609; 313/498–512
See application file for complete search history.

(56) References Cited

U.S. PATENT DOCUMENTS

| | | | | |
|---|---|---|---|---|
| 8,462,517 | B2 * | 6/2013 | Wojack et al. | 361/802 |
| 2009/0122476 | A1 * | 5/2009 | Won et al. | 361/679.21 |
| 2013/0033657 | A1 * | 2/2013 | Li et al. | 349/60 |

FOREIGN PATENT DOCUMENTS

| | | | |
|---|---|---|---|
| CN | 101441355 | A | 5/2009 |
| CN | 101649974 | A | 2/2010 |

* cited by examiner

*Primary Examiner* — Tracie Y Green
(74) *Attorney, Agent, or Firm* — Cheng-Ju Chiang

(57) ABSTRACT

The present invention provides a backlight module, which includes a backplane, a backlight source arranged inside the backplane, a light guide plate arranged inside the backplane, and an optic film assembly positioned on the light guide plate. The optic film assembly is connected to the backplane through snap fitting. The backlight module of the present invention includes a backplane that has side boards forming snap slots and an optic film assembly that forms fitting sections so that positioning and fixing of the optic film assembly and the backplane through snap fitting can be easily realized by means of a simple snap fitting arrangement. The drawback of the conventional way of using rivet that is adverse to bezel slimming can be eliminated and the problems of the conventional way that positioning through rivet may lead to easy detachment of the optic film assembly and deterioration of optic grade are also eliminated.

9 Claims, 5 Drawing Sheets

BACKLIGHT MODULE WITH OPTIC FILM ASSEMBLY MOUNTED THROUGH SNAP FITTING

BACKGROUND OF THE INVENTION

1. Field of the Invention

The present invention relates to the field of liquid crystal displaying, and in particular to a backlight module that facilitate bezel slimming.

2. The Related Arts

Liquid crystal display (LCD) has a variety of advantages, such as thin device body, low power consumption, and being free of radiation, and is thus widely used. Most of the LCDs that are currently available in the market are backlighting LCDs, which comprise a liquid crystal display panel and a backlight module. The working principle of the liquid crystal display panel is that liquid crystal molecules are interposed between two parallel glass substrates and a plurality of vertical and horizontal fine electrical wires is arranged between the two glass substrates, whereby the liquid crystal molecules are controlled to change direction by application of electricity in order to refract light emitting from the backlight module for generating images. Since the liquid crystal display panel itself does not emit light, light must be provided by the backlight module in order to normally display images. Thus, the backlight module is one of the key components of an LCD. The backlight module can be classified as two types, namely side-edge backlight module and direct backlight module, according to the position where light gets incident. The direct backlight module arranges a light source, such as a cold cathode fluorescent lamp (CCFL) or a light-emitting diode (LED) at the back side of the liquid crystal display panel to form a planar light source that directly provides lighting to the liquid crystal display panel. The side-edge backlight module arranges a backlight source of LED light bar at an edge of a back panel to be located rearward of one side of the liquid crystal display panel. The LED light bar emits light that enters a light guide plate through a light incident face of the light guide plate and is projected out through a light exit face after being reflected and diffused to thereby form, after transmitting through a set of optic films, a planar light source for the liquid crystal display panel.

Referring to FIG. 1, in a conventional design of backlight module, rivets 200 are commonly used to fix optic components, such as a light guide plate 300 and an optic film assembly 400. However, the rivets 200 have a relatively large portion that is used for riveting and thus requires a large amount of space. In other words, a predetermined space L must be kept between a rivet 200 and a side board 502 of a backplane 500. This negatively affects bezel slimming arrangement of the backlight module.

Further, in a making a bezel slimming arrangement, since the constraint that a mold frame imposes to an optic film assembly is reduced, the optic film assembly may get easily detached, leading to deterioration of optic grade.

SUMMARY OF THE INVENTION

An object of the present invention is to provide a backlight module, which has a simple structure and facilitates positioning of an optic film assembly of a slim-bezel backlight module so as to help making the bezel slimming and improving the optic grade of the backlight module.

To achieve the object, the present invention provides a backlight module, comprising a backplane, a backlight source arranged inside the backplane, a light guide plate arranged inside the backplane, and an optic film assembly positioned on the light guide plate. The optic film assembly is connected to the backplane through snap fitting.

The backplane comprises a bottom board and a plurality of side boards connected to the bottom board. The optic film assembly is connected to two opposite ones of the side boards through snap fitting.

The two opposite side boards form a plurality of outward-projecting bridges. Each of the bridges defines a snap slot with respect to the respective side board. The optic film assembly comprises a main body and a plurality of bent sections that extends outward from the main body to respectively correspond to the bridges of the side boards. Each of the bent sections forms a fitting section corresponding to the snap slot. The fitting section is insertable into the corresponding snap slot to thereby fix the optic film assembly to the backplane through snap fitting.

The two opposite side boards form a plurality of notches that is recessed inwardly of he backplane and respectively corresponds to the plurality of bridges and the bridges are respectively located in the notches. The bent sections of the optic film assembly are respectively received in the notches.

The snap slots have a thickness that is greater than or equal to thickness of the optic film assembly. The notches are recessed by such a depth that is greater than or equal to the thickness of the optic film assembly.

The bent sections form positioning holes corresponding to the bridges and the bridges are receivable in the corresponding positioning holes.

The fitting sections extend from one side of the positioning holes into the interior of the positioning holes.

The bridges are arranged in a direction parallel to the bottom board and the fitting sections extend from the side of the positioning holes that is close to free end of the bent sections in a direction toward the main body.

A plurality of through holes is formed in a connection between each of the bent sections and the main body.

Each of the side boards forms three uniformly-spaced bridges.

The efficacy of the present invention is that the present invention provides a backlight module that comprises a backplane having side boards that form snap slots and an optic film assembly that forms fitting sections so that positioning and fixing of the optic film assembly and the backplane through snap fitting can be easily realized by means of a simple snap fitting arrangement. The drawback of the conventional way of using rivet that is adverse to bezel slimming can be eliminated and the problems of the conventional way that positioning through rivet may lead to easy detachment of the optic film assembly and deterioration of optic grade are also eliminated.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
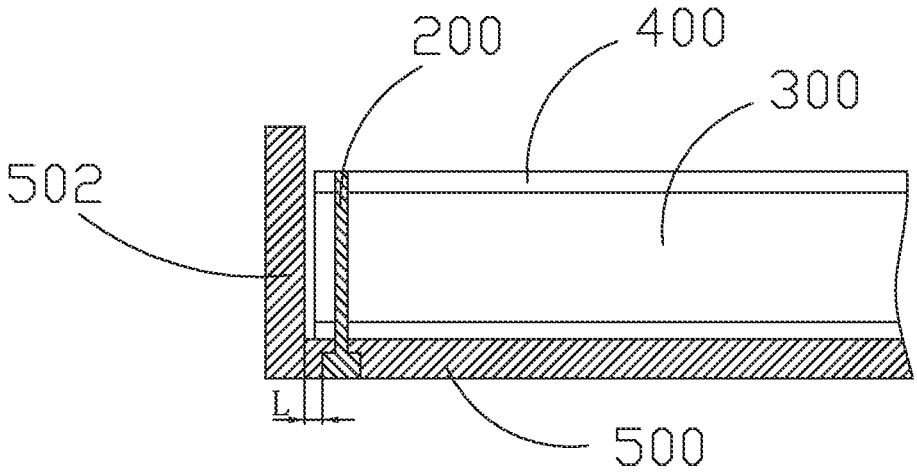
Fig. 1 (Prior Art)
FIG. 1 is a schematic view showing a conventional backlight module.
Figure 2:
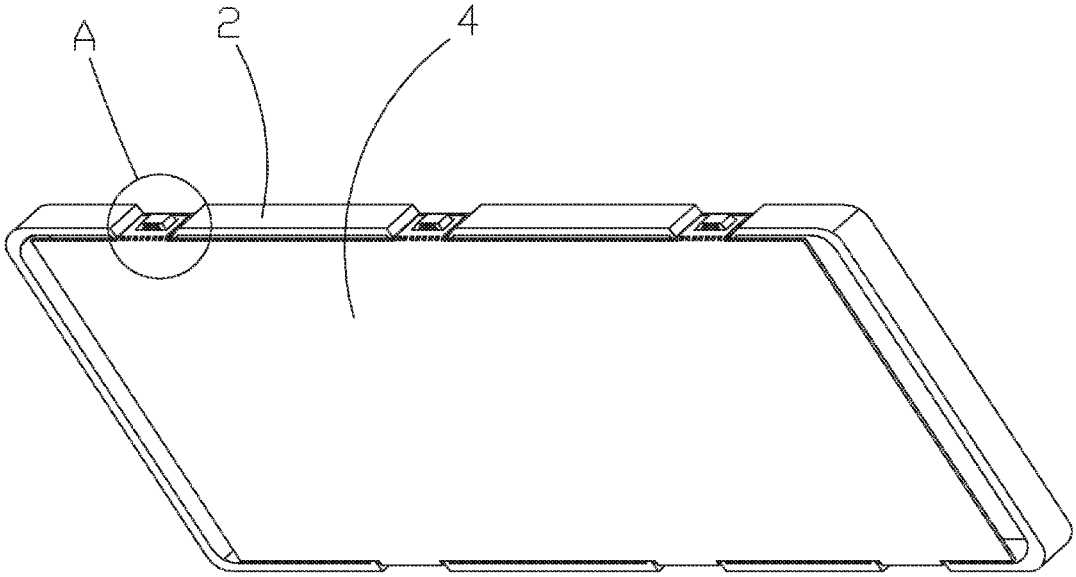
FIG. 2 is a perspective view showing a backlight module according to the present invention.
Figure 3:
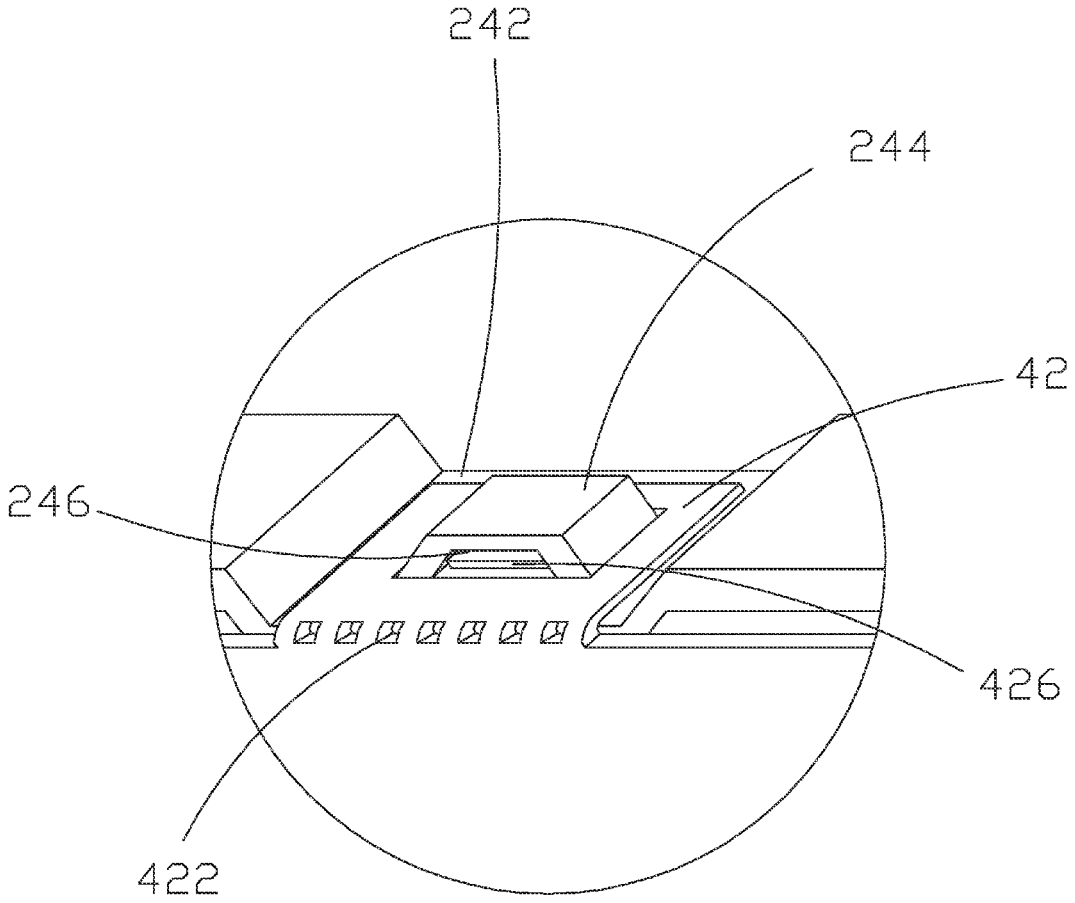
FIG. 3 is an enlarged view of circled portion A of FIG. 2.
Figure 4:
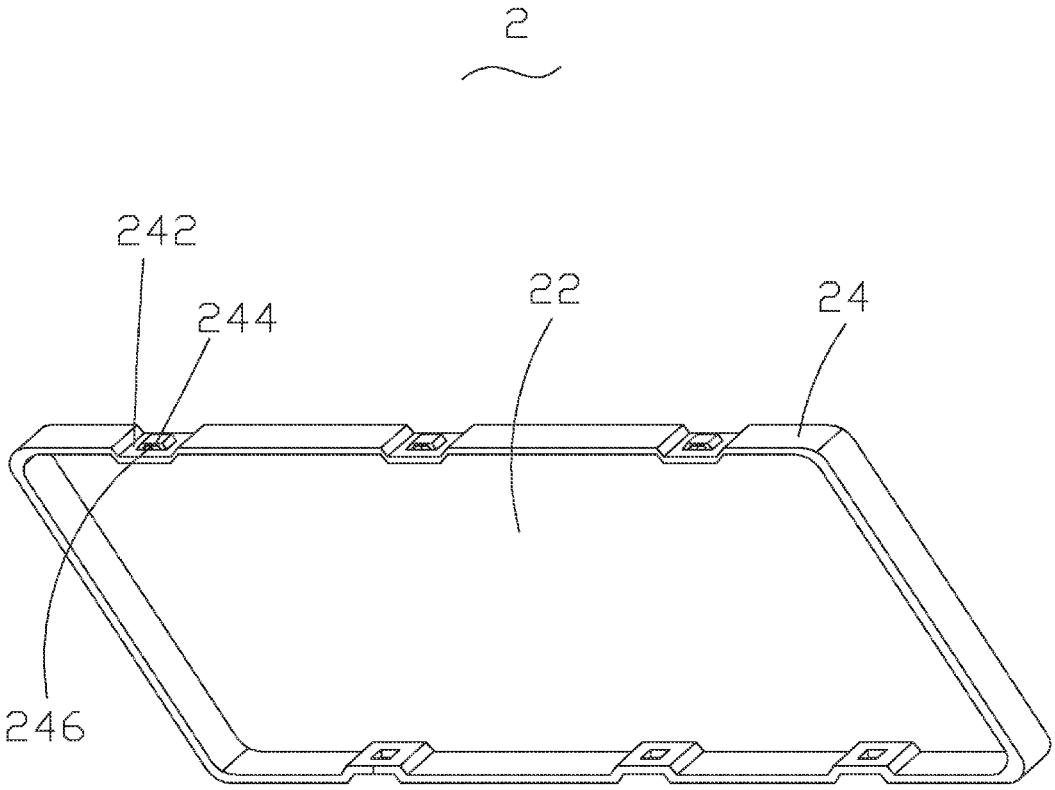
FIG. 4 is a perspective view showing a backplane of the backlight module according to the present invention.
Figure 5:
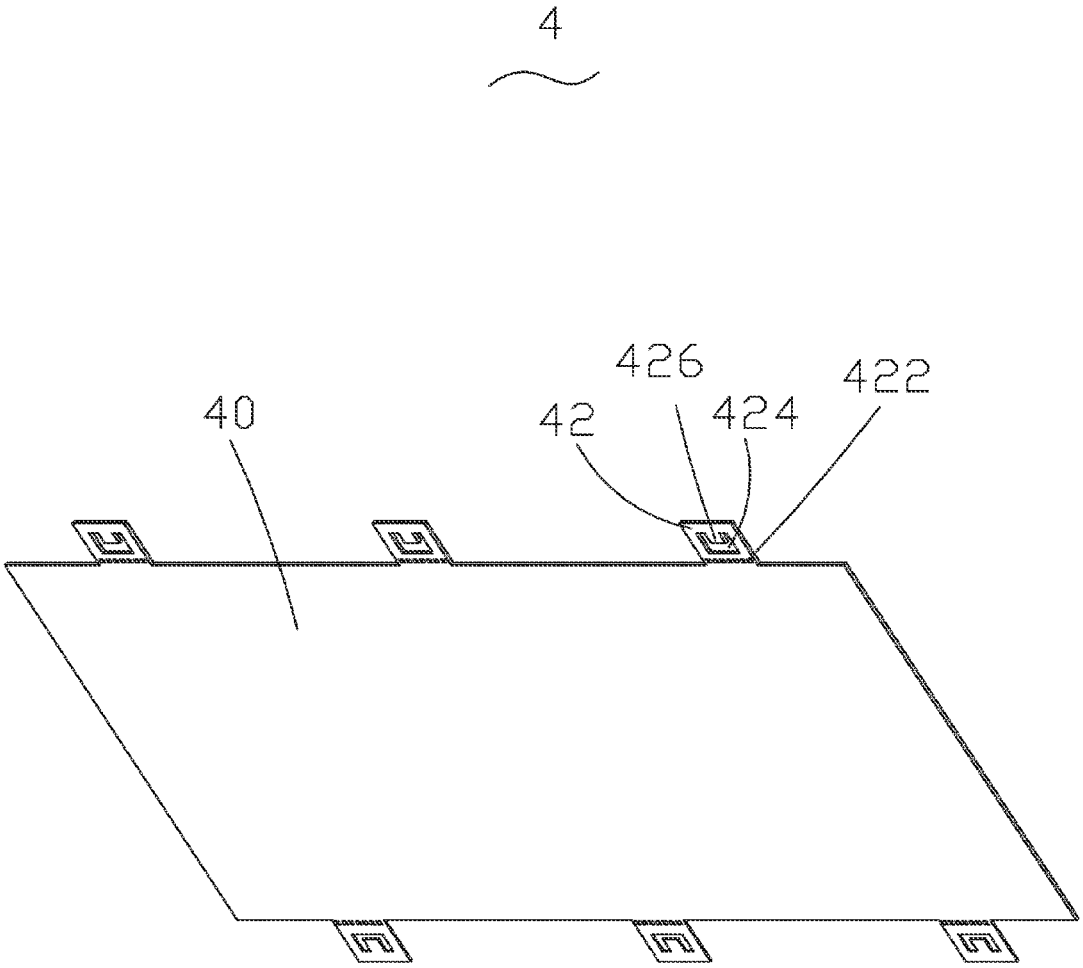
FIG. 5 is a perspective view showing an optic film assembly of the back module according to the present invention.

Referring to FIGS. 2-5, the present invention provides a backlight module, which comprises: a backplane 2, a backlight source (not shown) arranged inside the backplane 2, a light guide plate (not shown) arranged inside the backplane 2, and an optic film assembly 4 positioned on the light guide plate and connected to the backplane 2 through snap fitting. The optic film assembly 4 is connected to the backplane 2 through snap fitting to effect positioning and fixing of the optic film assembly 4.

The backplane 2 comprises a bottom board 22 and a plurality of side boards 24 connected to the bottom board 22. The optic film assembly 4 is connected to two opposite ones of the side boards 24 through snap fitting.

The two opposite side boards 24 form a plurality of outward-projecting bridges 244. In the instant embodiment, each of the side boards 24 forms three uniformly-spaced bridges 244. Each of the bridges 244 defines a snap slot 246 with respect to the side board 24. The optic film assembly 4 comprises a main body 40 and a plurality of bent sections 42 that extends outward from the main body 40 to respectively correspond to the bridges 244 of the side boards 24. Each bent section 42 forms a fitting section 426 corresponding to the snap slot 246. The fitting section 426 is insertable into the corresponding snap slot 246 to thereby fix the optic film assembly 4 to the backplane 2 through snap fitting.

The two opposite side boards 24 form a plurality of notches 242 that is recessed inwardly of he backplane 2 and respectively corresponds to the plurality of bridges 244 and the bridges 244 are respectively located in the notches 242. The bent sections 42 of the optic film assembly 4 are respectively received in the notches 242. The snap slots 246 have a thickness that is greater than or equal to thickness of the optic film assembly 4. The notches 242 are recessed by such a depth that is greater than or equal to the thickness of the optic film assembly 4. The arrangement of the 424 helps compensating the height that the bridges 244 might project beyond an outside surface of the side board 24 thereby keeping the outside surface of the side board 24 flat.

The bent sections 42 form positioning holes 424 corresponding to the bridges 244 and the bridges 244 are receivable in the corresponding positioning holes 424 thereby effecting positioning of the optic film assembly 4. The fitting sections 426 extend from one side of the positioning holes 424 into the interior of the positioning holes 424.

The bridges 244 are arranged in a direction parallel to the bottom board 22 and the fitting sections 426 extend from the side of the positioning holes 424 that is close to free end of the bent sections 42 in a direction toward the main body 40.

A plurality of through holes 422 is formed in a connection between each of the bent sections 42 and the main body 40 of the optic film assembly 4 to help bending the bent section 42. In other embodiments, the through holes 422 can be replaced by a fold line or other structures that equally help bending.

The present invention provides a backlight module that comprises a backplane having side boards that form snap slots and an optic film assembly that forms fitting sections so that positioning and fixing of the optic film assembly and the backplane through snap fitting can be easily realized by means of a simple snap fitting arrangement. The drawback of the conventional way of using rivet that is adverse to bezel slimming can be eliminated and the problems of the conventional way that positioning through rivet may lead to easy detachment of the optic film assembly and deterioration of optic grade are also eliminated.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A backlight module, comprising a backplane, a backlight source arranged inside the backplane, a light guide plate arranged inside the backplane, and an optic film assembly positioned on the light guide plate, the optic film assembly being connected to the backplane through snap fitting;

wherein the backplane comprises a bottom board and a plurality of side boards connected to the bottom board, the optic film assembly being connected to two opposite ones of the side boards through snap fitting; and wherein the two opposite side boards form a plurality of outward-projecting bridges, each of the bridges defining a snap slot with respect to the respective side board, the optic film assembly comprising a main body and a plurality of bent sections that extends outward from the main body to respectively correspond to the bridges of the side boards, each of the bent sections forming a fitting section corresponding to the snap slot, the fitting section being insertable into the corresponding snap slot to thereby fix the optic film assembly to the backplane through snap fitting.

2. The backlight module as claimed in claim 1, wherein the two opposite side boards form a plurality of notches that is recessed inwardly of the backplane and respectively corresponds to the plurality of bridges and the bridges are respectively located in the notches, the bent sections of the optic film assembly being respectively received in the notches.

3. The backlight module as claimed in claim 2, wherein the snap slots have a thickness that is greater than or equal to thickness of the optic film assembly, the notches being recessed by such a depth that is greater than or equal to the thickness of the optic film assembly.

4. The backlight module as claimed in claim 1, wherein the bent sections form positioning holes corresponding to the bridges and the bridges are receivable in the corresponding positioning holes.

5. The backlight module as claimed in claim 4, wherein the fitting sections extend from one side of the positioning holes into the interior of the positioning holes.

6. The backlight module as claimed in claim 5, wherein the bridges are arranged in a direction parallel to the bottom board and the fitting sections extend from the side of the positioning holes that is close to a free end of the bent sections in a direction toward the main body.

7. The backlight module as claimed in claim 1, wherein a plurality of through holes is formed in a connection between each of the bent sections and the main body.

8. The backlight module as claimed in claim 1, wherein each of the side boards forms three uniformly-spaced bridges.

9. A backlight module, comprising a backplane, a backlight source arranged inside the backplane, a light guide plate arranged inside the backplane, and an optic film assembly positioned on the light guide plate, the optic film assembly being connected to the backplane through snap fitting;

wherein the backplane comprises a bottom board and a plurality of side boards connected to the bottom board, the optic film assembly being connected to two opposite ones of the side boards through snap fitting;

wherein the two opposite side boards form a plurality of outward-projecting bridges, each of the bridges defining a snap slot with respect to the respective side board, the optic film assembly comprising a main body and a plurality of bent sections that extends outward from the main body to respectively correspond to the bridges of the side boards, each of the bent sections forming a fitting section corresponding to the snap slot, the fitting section being insertable into the corresponding snap slot to thereby fix the optic film assembly to the backplane through snap fitting;

wherein the two opposite side boards form a plurality of notches that is recessed inwardly of the backplane and respectively corresponds to the plurality of bridges and the bridges are respectively located in the notches, the bent sections of the optic film assembly being respectively received in the notches;

wherein the snap slots have a thickness that is greater than or equal to thickness of the optic film assembly, the notches being recessed by such a depth that is greater than or equal to the thickness of the optic film assembly;

wherein the bent sections form positioning holes corresponding to the bridges and the bridges are receivable in the corresponding positioning holes;

wherein the fitting sections extend from one side of the positioning holes into the interior of the positioning holes;

wherein the bridges are arranged in a direction parallel to the bottom board and the fitting sections extend from the side of the positioning holes that is close to free end of the bent sections in a direction toward the main body;

wherein a plurality of through holes is formed in a connection between each of the bent sections and the main body; and wherein each of the side boards forms three uniformly-spaced bridges.

* * * * *